US011225794B2

(12) United States Patent
Mikic

(10) Patent No.: US 11,225,794 B2
(45) Date of Patent: Jan. 18, 2022

(54) TRUSSED GIRDER FOR THE CONSTRUCTION INDUSTRY AND METHOD FOR PRODUCING A TRUSSED GIRDER OF THIS KIND

(71) Applicant: Peri AG, Weissenhorn (DE)

(72) Inventor: Erzad Mikic, Karlsruhe (DE)

(73) Assignee: Peri AG, Weissenhom (DE)

( * ) Notice: Subject to any disclaimer, the term of this patent is extended or adjusted under 35 U.S.C. 154(b) by 0 days.

(21) Appl. No.: 16/607,086

(22) PCT Filed: Apr. 10, 2018

(86) PCT No.: PCT/EP2018/059073
§ 371 (c)(1),
(2) Date: Oct. 21, 2019

(87) PCT Pub. No.: WO2018/192792
PCT Pub. Date: Oct. 25, 2018

(65) Prior Publication Data

US 2020/0378119 A1 Dec. 3, 2020

(30) Foreign Application Priority Data

Apr. 21, 2017 (DE) ..... 102017206743.8

(51) Int. Cl.
*E04C 3/16* (2006.01)

(52) U.S. Cl.
CPC ..... *E04C 3/16* (2013.01)

(58) Field of Classification Search
CPC ..... E04C 3/16
See application file for complete search history.

(56) References Cited

U.S. PATENT DOCUMENTS 5,996,303 A 12/1999 Pellock
2009/0094930 A1* 4/2009 Schwoerer ..... E04C 3/16 52/693

FOREIGN PATENT DOCUMENTS

| | | |
|---|---|---|
| AT | 174188 B | 3/1953 |
| CH | 50660 A | 6/1911 |
| DE | 1164627 | 3/1964 |
| DE | 102006021731 | 11/2007 |
| GB | 2016069 | 9/1979 |
| GB | 2383808 | 7/2003 |

* cited by examiner

*Primary Examiner* — Patrick J Maestri
(74) *Attorney, Agent, or Firm* — Loginov & Associates, PLLC; William A. Loginov

(57) ABSTRACT

A trussed girder for the construction industry, having an upper flange and having a lower flange made of square timber, which extend along the longitudinal axis of the trussed girder and which are connected to one another by a plurality of struts, which are each arranged so as to extend obliquely to the flanges. The struts are formed by at least one strut run, the upper side and underside of which are formed in an undulating manner in the axial direction and are arranged so as to extend parallel to one another with radii corresponding to one another. The strut run is mortised or dovetailed in the axial direction alternately by means of the upper flange and the lower flange and is formed as a single-piece wood material part. The invention additionally relates to a method for producing trussed girders of this kind, in particular on a mass scale.

13 Claims, 5 Drawing Sheets

TRUSSED GIRDER FOR THE CONSTRUCTION INDUSTRY AND METHOD FOR PRODUCING A TRUSSED GIRDER OF THIS KIND

FIELD OF THE INVENTION

The invention relates to a trussed girder for the construction industry and a method for producing trussed girders of this kind.

BACKGROUND OF THE INVENTION

Trussed girders have long been established in building practice and are used in the concrete construction of wall formwork, column formwork and ceiling formwork. The trussed girders have an upper and a lower flange which extend along the longitudinal axis of the trussed girder. The two flanges are, according to one style of construction, connected to one another by struts arranged in the manner of a framework. The struts are each arranged so as to extend obliquely relative to the flanges. The trussed girders have to have as great a load-bearing capacity and flexural rigidity as possible, in order to minimise the number of supports, steel walers or ceiling props required to support the trussed girders during the operational use of said girders. Trussed girders are mass produced, often at least partially from renewable raw materials, in particular wood or wood-based materials, not least for cost reasons. To this extent, the trussed girders are often made of square timber. One trussed girder of this kind is known, for example, from DE 10 2006 021 731 B4. The known trussed girder has proven itself in practice, not least due to the high load-bearing capacity and flexural rigidity thereof, and due to the weight thereof, which can be easily handled on the construction site. Due to the complex structural design, however, the trussed girder can only be produced at a high expense.

SUMMARY OF THE INVENTION

The problem addressed by the invention is therefore that of providing a trussed girder which has a sufficiently high load-bearing capacity and flexural rigidity, is simple and less expensive to produce, and which is easy to handle. Furthermore, the problem addressed by the invention is that of providing a simplified and inexpensive production method, in particular for mass producing trussed girders.

The problem concerning the trussed girder is solved by means of a trussed girder.

The trussed girder for the construction industry according to the invention comprises an upper flange and a lower flange made from square timber that extend along the longitudinal axis of the trussed girder and are connected to one another by a plurality of struts. The struts are each arranged so as to extend obliquely relative to the flanges, and, according to the invention, are formed by at least one strut run, the upper and undersides of which are formed in an undulating manner in the axial direction and are arranged so as to extend parallel to one another, having radii which correspond to one another, i.e. identical radii. The strut run is mortised or dovetailed in the axial direction alternately with the upper and the lower flange and is formed as a wood-based material part. The strut run is formed as a single-piece wood-based material part. The strut run is also formed without butt joints in the longitudinal direction. As a result of using a strut run of this kind, the trussed girder can be produced considerably more simply and inexpensively in comparison with the trussed girder known from DE 10 2006 021 731 B4. As such, the strut run can be directly cut from a prefabricated wood-based material board that is available on the market. The strut run can therefore be designed as a portion of a wood-based material board or be formed by a wood-based material board blank of this kind. The strut run therefore comprises a plurality of struts which transition with and into one another smoothly (and continuously), by means of which struts the two flanges are interconnected. Due to the strut run having an undulating upper side assigned to the upper flange, and an undulating underside assigned to the lower flange, the trussed girder can be produced more easily than is possible when using a continuous wood-based material board which is mortised or dovetailed on the opposite edge portions thereof with the flanges. The trussed girder can be produced, not least as a result of the strut run contoured in undulations, so as to have a load-bearing capacity and flexural rigidity that is sufficiently high enough for construction purposes. Consequently, the number of supports or ceiling props required to support the trussed girders, and the labour costs associated with the use thereof, can be minimised. Furthermore, through-recesses or pass-through regions are created between the two flanges and the strut run by means of the strut run which is formed as a whole in an undulating manner, by means of which recesses or regions the possible applications of the trussed girder are improved. As such, further mounting parts can be inserted through and/or attached in the region of the through-recesses. In addition, the trussed girder can be designed such that the distance between the struts corresponds in principle to the conventionally produced trussed girder, such that mounting parts which interact with the recesses between the struts can continue to be used without alteration.

Glued joints between the individual struts are omitted by using the strut run. As a result, it is possible to have fewer production steps and use less glue for the manufacture of the trussed girder. The raw wood material can be better utilized by using a wood-based material, since the high-quality pieces of solid wood are only used for the flanges, while even lower quality wood, which has knots for example, is still suitable for use in the wood-based material. The trussed girder can also, due to the predominant use of wood and wood-based material, be produced in an altogether resource-conserving manner and, upon reaching the lifespan thereof, also be disposed of in an environmentally friendly manner. The trussed girder is distinguished by a long lifespan as a result of the sturdy design. The identical radii of the undulating upper and underside of the strut run, as opposed to the usual concentric radii, also means that the strut run has a larger glued surface in the region of the flange, for an improved transmission of force, while the free struts between the flanges are narrower and therefore lighter than in conventional struts of the same width. This has two advantages. There is less waste in the production of the strut run, and a lower consumption of materials. Also, improved load-bearing properties can be achieved in the finished trussed girder of same weight, and a lower weight can be achieved in the trussed girder which has the same load-bearing properties.

The strut run preferably consists of a high-density wood fiber (board) material. Prefabricated, inexpensive, high-density (wood) fiber boards are available on the market in various sizes and are distinguished by a high load capacity and a high flexural rigidity. High-density wood fiber boards of this kind can also be designed to be sufficiently rot-proof for outdoor uses, using the relevant wood fiber bonding agent or the glue and the high level of compression of the wood fibers. It is self-evident that the wood fiber material can be additionally coated if required, in order to further increase the weather resistance thereof.

The strut run has lateral faces which are preferably, at least in portions, plane-parallel to one another. As a result, predefined flexural strength and torsional strength of the trussed girder can be more easily achieved and maintained. Furthermore, in the production of the trussed girder, the strut run can be cut from a wood fiber material board, in particular a high-density board, particularly easily and efficiently as a result.

The strut run preferably engages in grooves of the two flanges, each groove base of which forms a semi-circular profile in the longitudinal direction of the flange, lateral surfaces of the groove that extend in the longitudinal direction each including in particular an acute angle $\alpha$, and the strut run then also including a corresponding acute angle $\alpha$ together with the mortised or dovetailed portion of the strut run that is glued to each of said lateral surfaces. As a result, a particularly stable and durable mortise or dovetail of the strut run with the flanges is achieved. During the production method of the trussed girder, glue applied to the lateral surfaces for mortising or dovetailing is not or is only slightly moved in the direction of the groove bases when the strut run is inserted into the grooves. The glue therefore remains on the surfaces which are to be bonded to one another, as a result of which enough glue remains for firm and durable gluing in place.

The trussed girder can also be used in special constructions, for working on concrete formwork for example. As such, special lengths of the trussed girder of up to 18 meters can be readily achieved. When the length of the trussed beam exceeds the length of prefabricated and therefore inexpensive wood-based material or wood fiber material boards that are available on the market, the flanges can also be connected to one another by means of two or more strut runs which are arranged behind one another in the axial direction. In this case the strut runs can be preferably non-detachably connected to one another, in particular glued to one another, on the edge portions of the strut runs that face one another.

The method according to the invention for producing a plurality of the trussed girders described above comprises the following steps:

a) providing upper and lower flanges made of square timber;
b) providing wood-based material boards, in particular high-density wood fiber boards;
c) producing the strut runs by means of respectively cutting the wood-based material boards along a plurality of undulating cutting lines which are arranged in an extending direction of each wood-based material board so as to be offset parallel to one another and which each have radii which correspond to one another;
d) mortising or dovetailing an upper and a lower flange with at least one of the strut runs to form a trussed girder;
e) repeating step d) in order to produce each additional trussed girder.

The method of production according to the invention is particularly suitable for mass-producing trussed girders in an inexpensive manner. The strut runs, as a result of the corresponding radii of the mutually facing, undulating upper and underside of said runs, can be cut from or out of the wood-based material boards without any significant waste. Based on a rectangular-shaped wood fibre board, unavoidable waste only needs to be taken into account on the two mutually facing edges of the fibre board in the extension direction of the wood fibre board. In this case an initial or final undulating cut is therefore required in order to define an undulating edge contour of the edge strut runs which are each to be cut from the fibre board at the edge. By means of the mutually corresponding radii of the cutting lines, each cutting line which is arranged between two further cutting lines in the extension direction of the (wood) fibre boards defines the undulating upper side of a first strut run and the undulating underside of a second strut run. Overall, the trussed girders can therefore be produced for a reduced outlay in terms of materials, cost and time. For the purpose of producing the strut runs, completely automated or computer-controlled cutting systems can be readily used, said systems advantageously comprising automatic feeding of the wood-based material boards. The trussed girders can be assembled in principle supported by robotics.

BRIEF DESCRIPTION OF THE DRAWINGS

Further advantages of the invention can be found in the description and the drawings. The embodiment shown and described in the drawings is not to be understood as a definitive list, but instead has an exemplary nature for the depiction of the invention.

DETAILED DESCRIPTION

Figure 1:
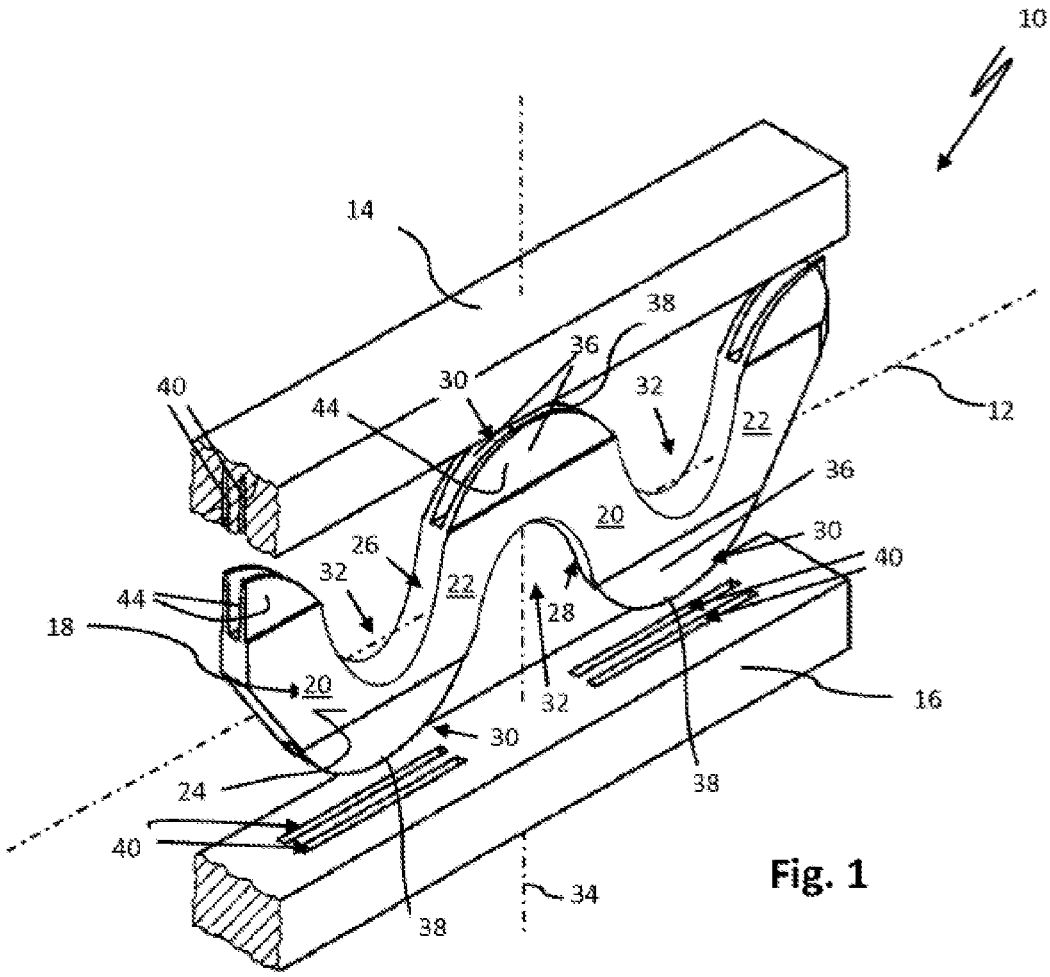
FIG. 1 shows an exploded perspective view of the components of a trussed girder having an upper flange and having a lower flange made of squared timber, and having a strut run which is formed as a single piece or part.

FIG. 1 shows an exploded perspective view of the components of a portion of a trussed girder 10 for the construction industry. The trussed girder 10 extends a few meters in the direction of the longitudinal axis 12 thereof and has dimensions which are common for a trussed girder of this kind in the construction industry. It is self-evident that the trussed girder 10 can be provided in special lengths, in particular for special constructions, as can be required in formwork for concrete ceilings or concrete walls.

The trussed girder 10 has an upper flange 14 made from square timber and a lower flange 16 made from square timber. A strut run 18 which is formed as a single piece is used to connect the two flanges 14, 16. The strut run 18 is formed as a single-piece wood-base material board blank, in this case as a high-density fiber board blank. The strut run 18 therefore consists of a high-density wood fiber material.

The strut run has struts 20, 22, which are each arranged extending obliquely relative to the flanges 14, 16. Lateral faces 24 of the struts 20, 22 that face away from one another are designed to be plane parallel or substantially plane parallel to one another in this case.

According to FIG. 1, the strut run 18 has an undulating basic shape. The strut run 18 therefore has an upper and an underside 26, 28, each of which undulate in the axial direction. The strut run 18 thus forms wave crests or protrusions 30 and wave troughs or indentations 32 on the upper and lower sides, respectively. In the direction of the vertical axis 34 of the strut run 18 and of the trussed girder 10, which axis runs orthogonally relative to the longitudinal axis, each indentation 32 of the upper side 26 is arranged relative to a protrusion 30 of the underside 28 of the strut run 18. In a corresponding manner, a protrusion 30 of the upper side 26 of the strut run 18 is arranged in alignment with an indentation 32 of the underside.

When the trussed girder 10 is in the assembled state, the strut run 18 can be mortised or, according to the embodiment shown in FIG. 1, dovetailed with the two flanges 14, 16. For this purpose, in the region of the wave crests of the upper and underside 26, 28 of the strut run 18, each strut run has a plurality, in this case two, dovetails 36. The width of the dovetails 36 tapers, preferably along the vertical axis 34 of the strut run 18 in the direction of the apex or the free end 38 thereof. The dovetails 36 therefore have a triangular or substantially triangular cross section. When the trussed girder 10 is in the joined state, the dovetails 36 engage in grooves 40 of the flanges 14, 16, which grooves extend in the axial direction of the trussed girder 10. One dovetail 36 of the strut run 18 is associated with each groove 40.

Figure 2:
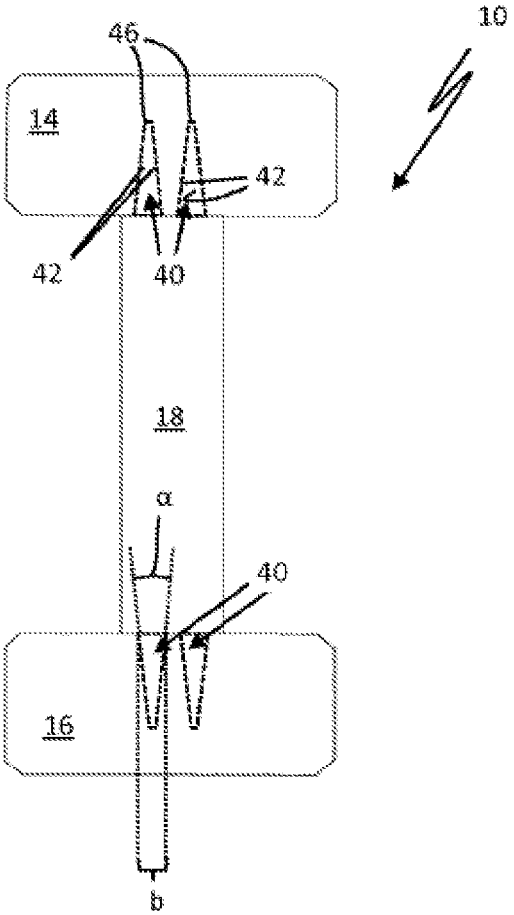
FIG. 2 shows a cross section of the trussed girder according to FIG. 1.

The dovetails 36 of the strut run 18 are glued to lateral walls 42 of the grooves 40, according to FIG. 2. The dovetails 36 of the strut run 18 that are arranged on the upper side are therefore glued into the grooves 40 of the upper flange 14, and the dovetails 36 of the strut run 36 that are arranged on the underside are each glued into grooves 40 of the lower flange 16. The lateral walls 42 of the grooves 40 that extend in the axial direction can each include an acute angle $\alpha$, according to FIG. 2. In a corresponding manner, the lateral surfaces 44 (cf. FIG. 1) of the dovetail 36 of the strut run 18 that is glued in the respective groove 40, which lateral surfaces are glued to said lateral walls 42, can include a corresponding acute angle $\alpha$. The respective lateral surfaces 44 of the dovetails 36 and of the grooves 40 are therefore not parallel to one another in this case. The dovetails 36 therefore taper in the direction of the free end 38 thereof. The width b of the grooves 40 correspondingly decreases along the vertical axis 34 in the direction of the groove base 46 as a result of the inclusion of the acute angle $\alpha$. As a result, glue applied to the lateral surfaces 44 is not or is only slightly moved in the direction of the groove base 46 when the dovetails 36 are inserted into the grooves 40. The glue therefore remains on the surfaces of the grooves 40 and the dovetails 36, which surfaces are to be glued to one another, as a result of which enough glue remains for firm and durable gluing of the lateral surfaces 44 in place.

Figure 3:
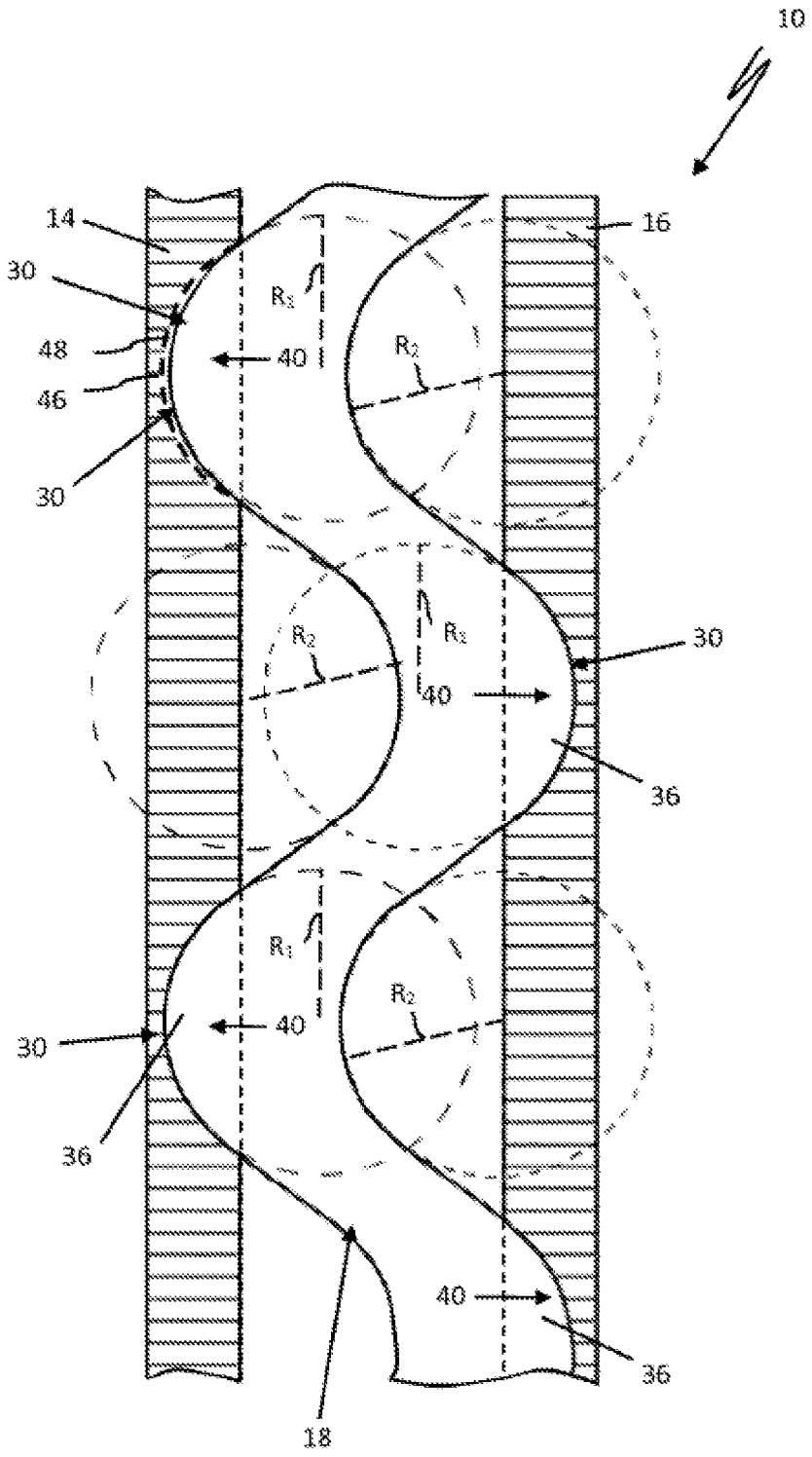
FIG. 3 shows a partial longitudinal section of the trussed girder according to FIG. 1.

FIG. 3 shows a longitudinal section of a portion of the joined trussed girder 10. Together with the flanges 14, 16, each of the struts 20, 22 includes an acute angle of approximately 45° that is not described in greater detail. The dovetails 36 of the strut run 18 extend into the grooves 40 of the flanges 14, 16 and are glued to the lateral walls 42 (FIG. 2) thereof in a precisely fitting manner. The groove bases 46 of the grooves 40 each have a semi-circular profile in the axial direction. The dovetails 36 or the protrusions 30 of the strut run 18 form a corresponding semi-circular profile. A gap 48 can be provided between the groove-base-side free end 38 of the dovetails 36/protrusions 30 and the groove base 46 of the groove 40, in which the relevant dovetail 36 is glued, as shown in the groove 40 in the upper left of FIG. 3. This gap 48 can receive the amounts of glue which are displaced when joining the strut run 18 to the flanges 14, 16 by means of pressing the lateral surfaces 44 of the dovetails 36 against the lateral walls 42 of the grooves 40, and it is therefore possible to insert the dovetails 36 into the grooves 40 of the flanges 14, 16 without said amounts of glue causing displacement resistance.

The upper and the underside 26, 28 of the strut run 18 are arranged so as to extend parallel to one another. It should be noted that the protrusions 30 and indentations 32 of the strut run 18 that are arranged in alignment with one another in the direction of the vertical axis 34 each have radii $R_1$, $R_2$ which correspond to one another. All protrusions 30 and indentations 32 of the strut run 18 have radii $R_1$, $R_2$ which correspond to one another. The identical radii R1, R2, as opposed to the usual concentric radii, allow the strut run 18 to have a larger glued surface in the region of the flange 14, 16 for an improved transmission of force, while the free struts 24 between the flanges 14, 16 are narrower and therefore lighter than in conventional struts of the same width. This results in two advantages; less waste in the production of the strut run 18, and a lower consumption of materials, and also that improved load-bearing properties can be achieved in the finished trussed girder 10 of same weight, and a lower weight can be achieved in the trussed girder which has the same load-bearing properties.

Figure 4:
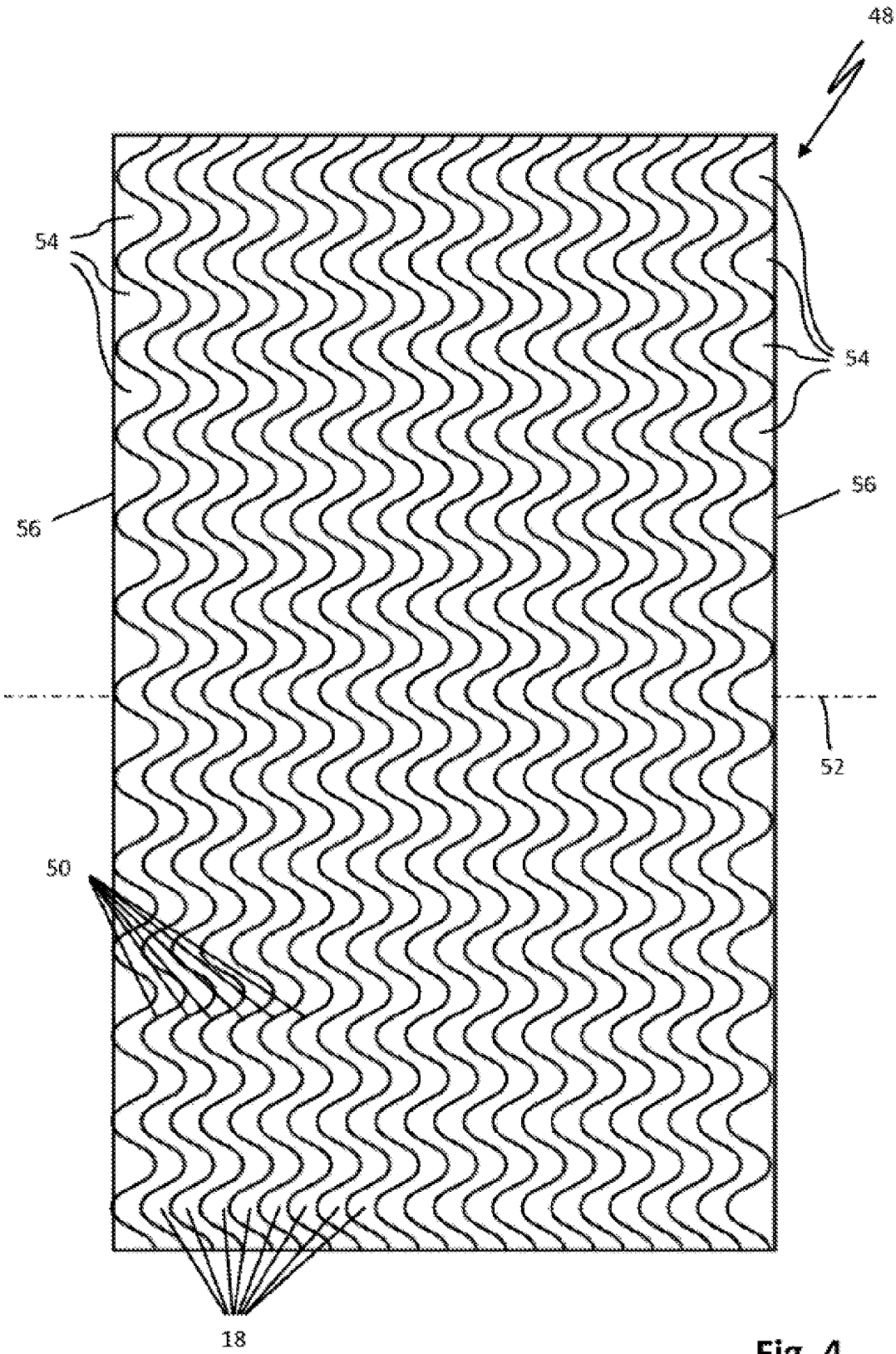
FIG. 4 shows a wood fiber board having individual cutting lines, along which the strut runs for a plurality of trussed girders according to FIG. 1 are cut out or cut free.
Figure 5:
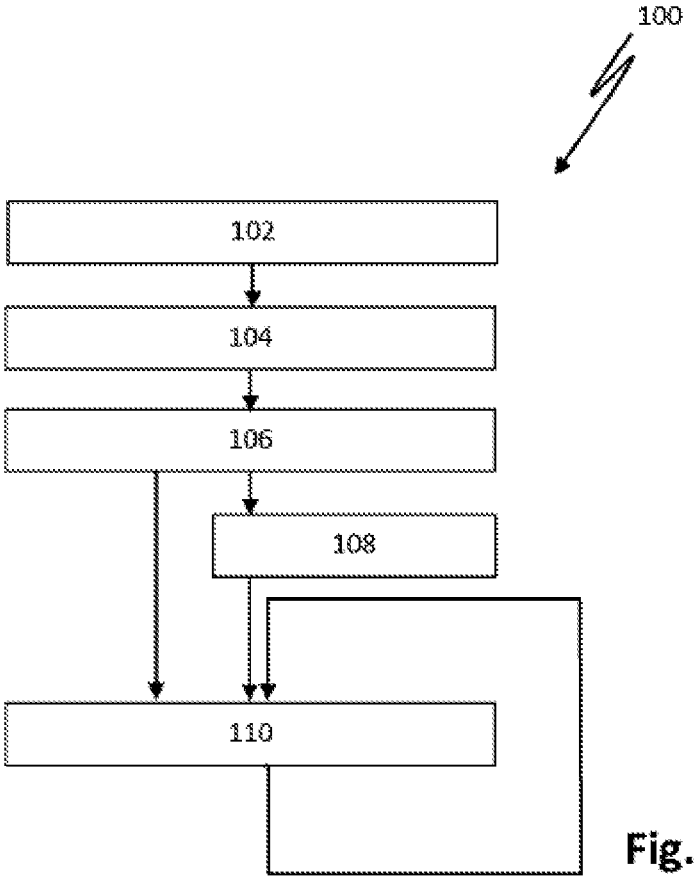
FIG. 5 is a block diagram depicting a method of producing one or a plurality of trussed girders.

By means of the undulating shape and contouring of the strut run 18, the trussed girder 10 can be produced more easily and inexpensively, as is described below with additional reference to FIGS. 4 and 5. The method of production 100 according to the invention, according to the block diagram shown in FIG. 5, comprises the following steps:

In a first step 102, upper and lower flanges 14, 16 are provided which are provided with the grooves. In a further step 104, a plurality of wood-based material boards 48, in particular high-density (wood) fiber boards are provided, of which a side view of one wood-based material board 48 is shown in FIG. 4 as an example.

In a further step 106, the strut runs 18 are produced by means of respectively cutting or sawing the wood-based material boards 48 along a plurality of undulating cutting lines 50. The cutting lines 50 are arranged offset and parallel to one another in an extension direction 52 of the relevant wood-based material board and each have the mutually corresponding (i.e. identical) radii $R_1$, $R_2$ (FIG. 3). As a result, waste 54 of the wood-based material board only arises substantially at edges 56 of the wood-based material board 48 which are arranged opposite one another in the extension direction 52 of the wood-based material board 48. If necessary, the strut runs 18 also have to be shortened to a length suitable for the trussed girder 10 (FIG. 3).

If the strut run is dovetailed with the flanges 14, 16 (FIGS. 1 to 3), the dovetails 36 of the strut run 18 are produced in step 108 by a machining production method, preferably by means of milling.

In a subsequent step 110, in each case an upper and a lower flange 14, 16 is dovetailed or mortised with at least one of the strut runs 18 to form a trussed girder 10. In this case the dovetails 36 of the strut run 18 are glued to the respective lateral walls 42 of the grooves 40 (FIG. 2) of the two flanges 14, 16. Step 110 is repeated to produce each further (structurally identical) trussed girder 10.

By means of the production method 100 according to the invention, the trussed girders 10 can be produced in large quantities, in a manner which substantially completely utilises the material of the wood-based material boards or high-density (wood) fiber boards 48 used in production, i.e. in a manner which has low material input, is inexpensive and requires low effort.

The invention claimed is:

1. A trussed girder for the construction industry, comprising:

an upper flange and a lower flange made of square timber, the upper flange and the lower flange extending along a longitudinal axis of the trussed girder and being connected to one another by a plurality of struts which are each arranged so as to extend obliquely to the upper flange and the lower flange, the struts being formed by at least one strut run, an upper side and an underside of the strut run being formed in an undulating manner in an axial direction and the upper side and the underside arranged so as to extend parallel to one another and defining identical radii R1, R2, the strut run being mortised or dovetailed in the axial direction with the upper flange and the lower flange and being formed as a single-piece wood-based material part.

2. The trussed girder according to claim 1, wherein the strut run consists of a high-density wood fiber material.

3. The trussed girder according to claim 1, wherein the strut run has lateral faces which are arranged so as to extend plane-parallel to one another.

4. The trussed girder according to claim 1, wherein the strut run engages in grooves of the upper flange and the lower flange, each groove base of which forms a semi-circular profile in the longitudinal direction of the flanges, the lateral walls of the groove that extend in the longitudinal direction each including an acute angle $\alpha$, and the strut run, together with the mortises or dovetails thereof which are glued to each of said lateral walls, including a corresponding acute angle $\alpha$.

5. The trussed girder according to claim 3, wherein the upper flange and the lower flange are connected to one another by two or more strut runs which are arranged behind one another in the axial direction.

6. A method for producing a plurality of trussed girders, comprising:

a) providing upper and lower flanges made of square timber;

b) providing wood-based material boards;

c) producing the strut runs by respectively cutting the wood-based material boards along undulating cutting lines which are arranged in an extension direction of the relevant wood-based material board so as to be offset parallel to one another and define identical radii R1, R2;

d) mortising or dovetailing an upper and a lower flange with at least one of the strut runs to form a trussed girder;

e) repeating step d) for each additional trussed girder.

7. The method of claim 6, wherein the wood-base material boards comprise high density wood fiber boards.

8. The trussed girder according to claim 1, wherein in the direction of the longitudinal axis, adjacent circles with the identical radii R1, R2 each have center points spaced less than three radii R1, R2 apart.

9. The trussed girder according to claim 8, wherein perpendicular to the longitudinal axis, circles with the identical radii R1, R2 are respectively arranged overlapping protrusions and indentations defined by the plurality of struts.

10. The trussed girder according to claim 1, wherein a gap is defined between a groove-base-side free end of dovetails and a groove base of a groove by the semi-circular profile of the groove base having a radius which is smaller than the radius R1 of the protrusion of the tine extending into the groove.

11. A trussed girder, comprising:

an upper flange;

a lower flange made of square timber, the upper flange and the lower flange extending along a longitudinal axis of the trussed girder; and a plurality of struts which are each arranged so as to extend obliquely to the upper flange and the lower flange such that the upper flange and the lower flange are connected to one another by the plurality of struts, the plurality of struts being formed by at least one strut run defining an upper side and an underside formed in an undulating manner in an axial direction and the upper side and the underside arranged so as to extend parallel to one another and defining identical radii R1, R2, the strut run being mortised or dovetailed in the axial direction with the upper flange and the lower flange and being formed as a single-piece wood-based material part;

wherein the strut run engages in grooves of the upper flange and the lower flange, each groove base of which forms a semi-circular profile in the longitudinal direction of the flanges, the lateral walls of the groove that extend in the longitudinal direction each including an acute angle $\alpha$, and the strut run, together with the mortises or dovetails thereof which are glued to each of said lateral walls, including a corresponding acute angle $\alpha$, wherein a gap is defined by a free end of the dovetails on a groove base of the groove in which the respective dovetail is glued so as to receive displaced glue during pressing.

12. The trussed girder of claim 11, wherein the strut run defines a plurality of protrusions each having a radius of R1, and the strut run defines a plurality of indentations each having a radius of R2.

13. The trussed girder of claim 12, wherein central points of circles defined by adjacent protrusions and indentations are offset axially.

* * * * *